United States Patent [19]

Fabrizio

[11] Patent Number: 4,534,261

[45] Date of Patent: Aug. 13, 1985

[54] VENT KEY MODIFICATION FOR FLUTE

[76] Inventor: Raymond Fabrizio, 780 Dry Creek Rd., Monterey, Calif. 93940

[21] Appl. No.: 480,388

[22] Filed: Mar. 30, 1983

[51] Int. Cl.[3] ..... G10D 7/02

[52] U.S. Cl. ..... 84/384

[58] Field of Search ..... 84/380, 382, 384

[56] References Cited

PUBLICATIONS

The Flutist Quarterly, The National Flute Association, Inc., vol. X, No. 1, Fall, 1984, pp. 1–23.

Pan, The Journal of the British Flute Society, vol. 2, No. 2, Jun. 1984, pp. 47 and 48; No. 3, Dec. 1984, p. 21.

The Development of the Modern Flute, Nancy Toff, Taplinger Publishing Co., Inc., Copyright 1979.

*Primary Examiner*—L. T. Hix

*Assistant Examiner*—Douglas S. Lee

*Attorney, Agent, or Firm*—James R. Cypher

[57] ABSTRACT

An improvement in a modern Boehm system flute having a closed G# which includes deleting the standard duplicate G# key and extra hole and adding a small vent area close to the G key which is covered by a small vent key conjointly operable with the opening and closing of the G key.

4 Claims, 14 Drawing Figures

VENT KEY MODIFICATION FOR FLUTE

BACKGROUND OF THE INVENTION

This invention relates to an improvement in the flute and more particularly in the modern Boehm closed G# flute.

It is a principal object of the invention to provide in a closed G# flute a means of improving the third octave notes, especially the high E. More particularly it is an object to provide in a modern closed G# flute a novel and improved construction and arrangement of parts by means of which the normally difficult high E and other notes in the third octave can be played more easily and with more control.

On the original Boehm flute with its open G# arrangement, high E is not a problem. However, it calls for a different fingering for both the G and G# and for this reason is rarely played today.

The standard*, commonly played, closed G# flute requires an extra hole with its key connected to the G key. This "duplicate G# mechanism" which is believed to have originated in the mid 1850's requires an extra hole which is placed opposite the G# hole so that when the G key is closed, G# can be played by pressing the G# lever which opens the G# key. The duplicate G# hole is necessary also in order to vent the tone A. The two holes at the same longitudinal location on the tube create a widening of the bore at that point and a consequent unnatural turbulence in the vibrating air column; hence the problem with high E familiar to all flutists.

*By 1920, William S. Haynes estimated ninety-five percent of all players used the closed G# flute, *The Development of the Modern Flute,* Nancy Toff at Page 173, Tapliner Publishing Co., Inc., Copyright 1979.

Heretofore the problem has been dealt with in four ways:

1. Over a hundred years ago the "Dorus" mechanism attempted to make the open G# flute operate like a closed G# flute. It never became standard because of an inherently spongy feel to the G key which, through a spring shared with the G# key, closed the G# key and also allowed the G# key to be opened by a separately mounted G# lever.

2. The split G mechanism, in rare use, improves the high E but requires an awkward stretch of the little finger to close the G# vent key, a gesture practical only on long notes. There is also a problem with adjustment, since the independently sprung G and G# vent keys must close together.

3. The split E mechanism, more common, but still not in common use, improves the high E but has two disadvantages:

(1) It has the same adjustment problems of the split G, and (2) Flute builders are reluctant to build it.

4. Recently there have been attempts to eliminate the duplicate G# hole and to enlarge the G hole to vent the tone A. This had been tried by Boehm, the inventor of the modern flute, on the famous Macauley flute (now in the Dayton Miller collection in Washington, examined and played by me in April of 1982). This flute, as well as recent flutes eliminating the duplicate G# made by builders Jack Moore (at my request) and Tip Lamberson a year later (both exhibited at conventions of the National Flute Association), prove out the reason why Boehm never made a second flute with that specification: The low A is dull in quality and somewhat flat in pitch for lack of sufficient venting.

5. Some manufacturers (notably Sankyo Prima) make the duplicate G# hole smaller. But this smaller hole, while helping the high E, dulls the quality of the low A because of insufficient venting. The problem with a single vent hole in the normal duplicate G# position is that when it is large enough to vent the A, it has an adverse affect on high E.

SUMMARY OF THE INVENTION

The invention consists in the rearrangement and interconnection of certain parts to eliminate undesirable acoustical effects inherent in prior art designs without requiring a change of fingering.

A feature of the invention consists in the elimination of the duplicate G# key and vent hole, and providing a novel and improved vent hole and key in a different location and of a different size.

Another feature of the invention consists in the construction of a key assembly to open and close the vent hole.

Still another feature of the invention consists in the relocation of the G# lever to provide space for the vent hole and its key assembly.

Accordingly, my invention has the following advantages:

1. No split mechanism to go out of adjustment.
2. Improved stability of the third octave generally.
3. Improved high E.
4. Full venting for low and middle A.
5. Easier slurring between high E and other notes.
6. Simple, inexpensive, and rigid construction.
7. Convertibility of standard flutes to this construction.
8. Better sealing of pads by virtue of a single small hole or smaller twin holes.
9. Stronger tube due to elimination of large duplicate G# hole. The single hole or two small holes preserve more of the tube.

DESCRIPTION OF THE PREFERRED EMBODIMENTS

Figure 14:
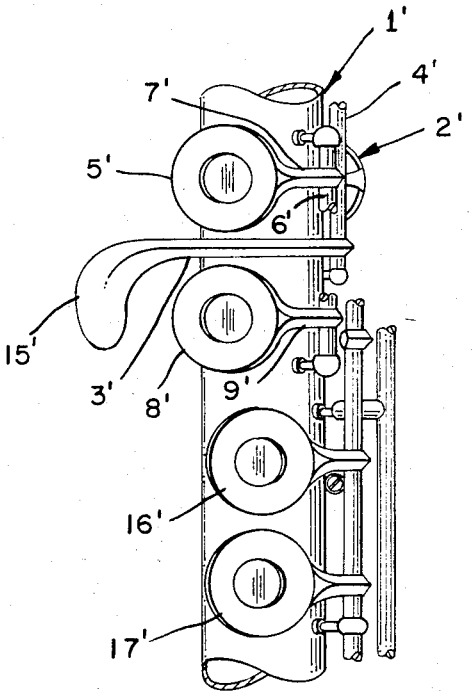
FIG. 14 (PRIOR ART)
FIG. 14 is a portion of a prior art offset Boehm system flute taken in the same section of the type of flute shown in FIG. 1 and bounded by the arrows 2—2.
Figure 13:
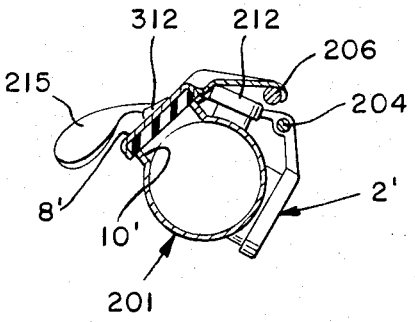
FIG. 13 is a cross sectional view of the flute shown in FIG. 10 taken along line 13—13.

Referring to Prior Art FIG. 14, the modified Boehm system flute 1' having a closed G# Key 2' is shown. The G# lever 3' is pivoted about axle 4' and opens G# key 2' when pressed at touch point 15. A spring biases the G# key in the closed position.

The standard duplicate G# Key 5' is connected to axle 6' by arm 7' and opens and closes with G Key 8' which is also connected to axle 6' by an arm 9'. The duplicate G# key 5' is biased to an open position and covers an extra hole having an opening size equal to the A hole opening 10'. The G key 8' is offset from keys 16' and 17' as is the practice in student flutes.

The preferred form of the invention is illustrated in a portion of flute 1 shown in FIGS. 1-4.

The G key 8' covering the A hole 10' and keys 16' and 17', and G# key 2' remain in the same position as in the prior art flute illustrated in FIG. 14. The duplicate G# key 5' and extra hole, however, are deleted. A vent means is provided having an open area substantially smaller than the extra hole opening. Preferably the vent means consists of a single small hole 11 covered by cover member 12. The vent hole 11 is located between the deleted extra hole and the A hole 10'. The optimum placement is as close to the A hole as possible. The vent hole 11 may be placed at any lateral position on the flute tube. The in line position with the G key 8' is only one possible position. The cover 12 for the vent hole is connected to a vent arm 13 which is fixedly hinged to axle 6. The G key 8' and vent key 14 which includes the cover 12 and arm 13 are both biased to the open position and open and close conjointly.

Addition of the vent key 14 requires the relocation of the standard G# lever 3' of the standard flute. The G# lever 3 is moved along the longitudinal axis toward the foot of the flute. Lever 3 pivots about axle 4 and opens the G# key 2' which is normally biased to a closed position by a spring. The touch portion 15 of the G# lever 3 is elongated in the direction of the head of the flute so that the same fingering is maintained.

The improved flute is played in an identical manner as the prior art flute shown in FIG. 14.

Figure 9:
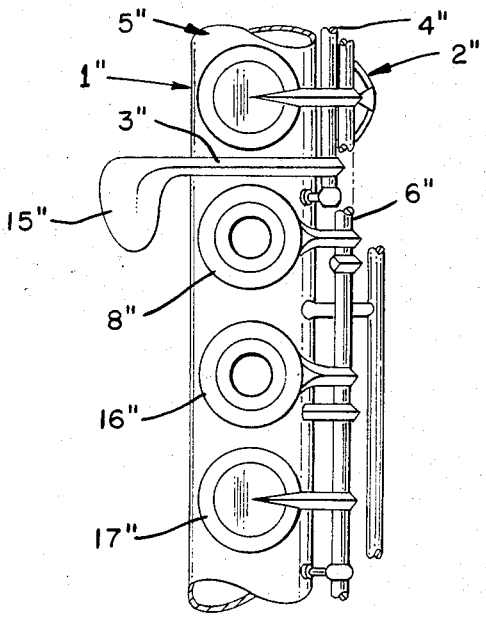
FIG. 9 (PRIOR ART)
FIG. 9 is an enlarged view of a portion of a prior art in line Boehm system flute taken in the same area of the flute shown in FIG. 5 and generally in the area indicated by the arrows 6—6.
Figure 7:
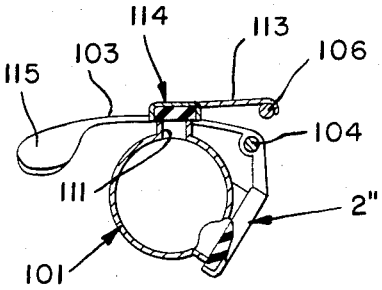
FIG. 7 is a cross section of the flute shown in FIG. 6 taken along line 7—7.
Figure 8:
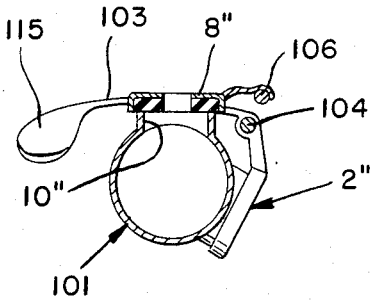
FIG. 8 is a cross sectional view of the flute in FIG. 6 taken along line 8—8.
Figure 5:
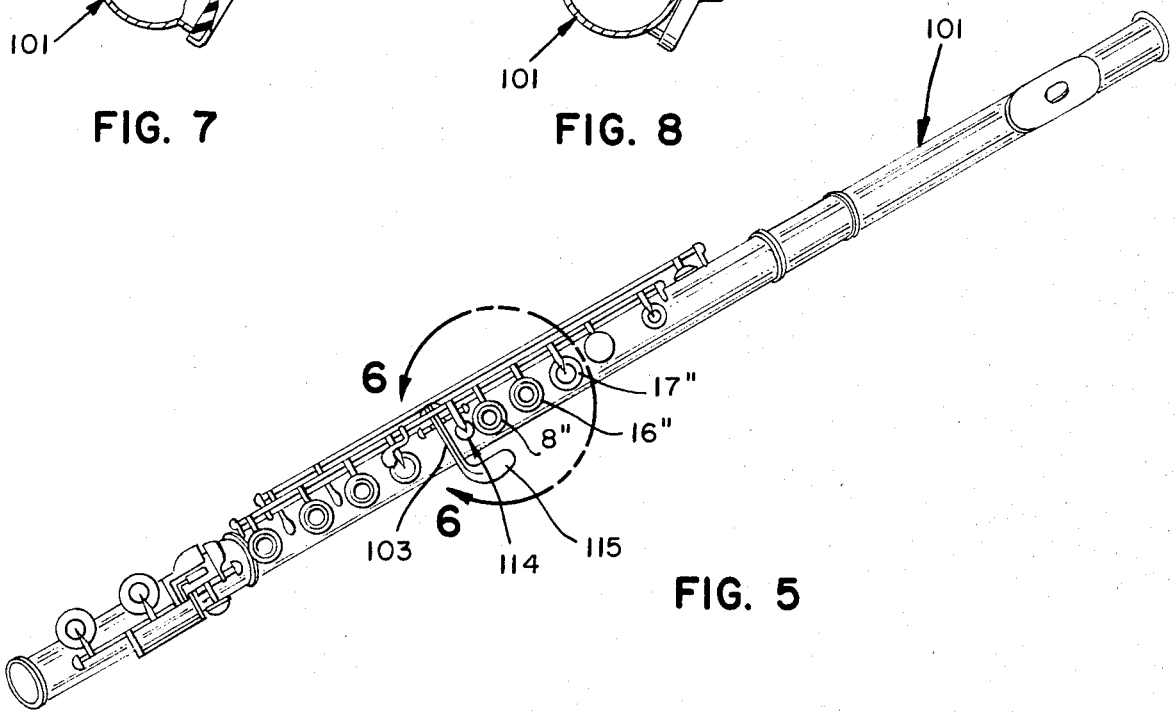
FIG. 5 is a perspective view of an in-line Boehm system flute incorporating the present invention.

FIG. 9 shows a portion of a prior art in line open hole flute with the standard closed G# key 2". The duplicate G# key 5" is identical to the duplicate G# key 5' of the prior art flute illustrated in FIG. 14 except that the key is in line with the other keys 8", 16" and 17". The G# lever 3" and touch portion 15" is shown in its usual position and mounted on axle 4".

Figure 2:
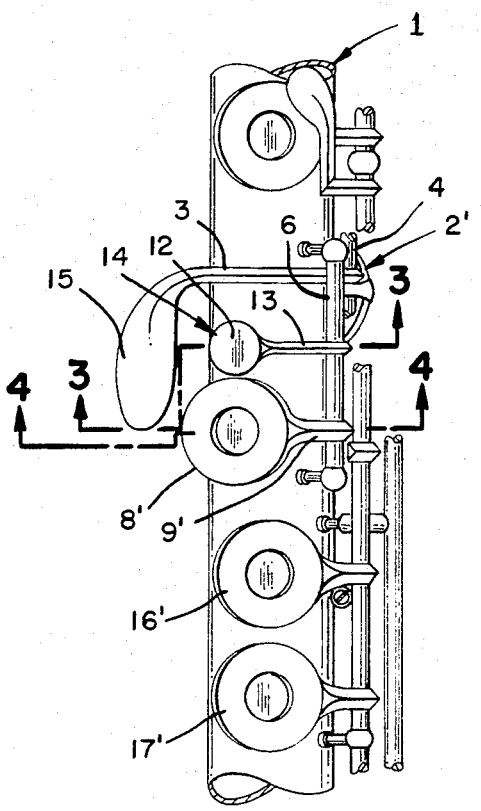
FIG. 2 is an enlarged view of a portion of the flute shown in FIG. 1 taken along 2—2.
Figure 3:
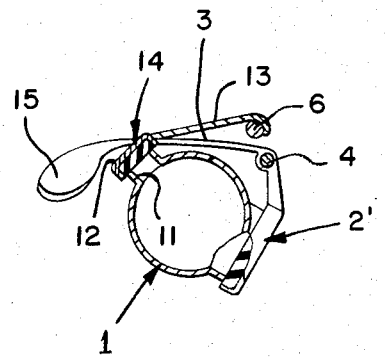
FIG. 3 is a cross sectional view taken along line 3—3 of FIG. 2.
Figure 4:
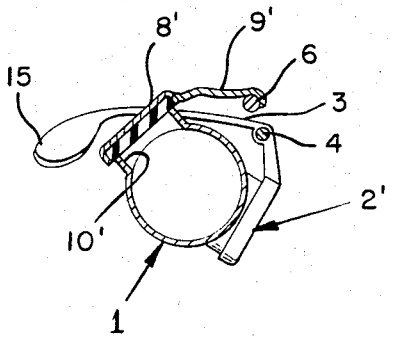
FIG. 4 is a cross sectional view taken along line 4—4 of FIG. 2.
Figure 1:
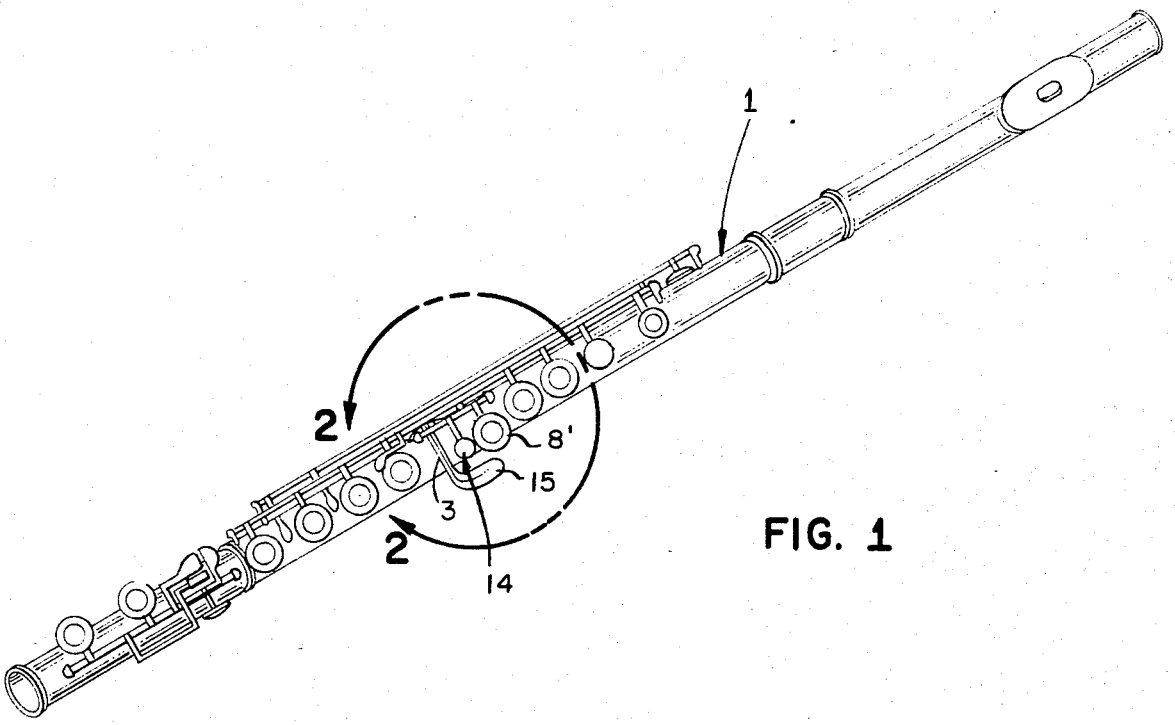
FIG. 1 is a perspective view of a modified Boehm system flute having an offset G key incorporating the present invention.
Figure 6:
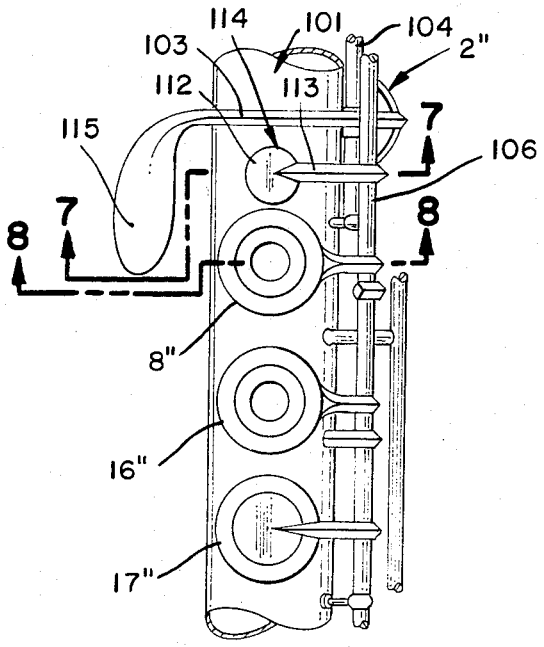
FIG. 6 is an enlarged view of a portion of the flute in FIG. 5 taken along line 6—6.

The portion of the in-line flute 1" shown in Prior Art FIG. 9 with the modification of the present invention is illustrated in FIG. 6 and numbered 101. The duplicate G# key 5" is eliminated and a vent key 114 identical to the vent key of FIG. 2 is added. The vent key 114 includes a cover 112 which is attached to axle 106 by arm 113. The vent key is located at any longitudinal position between the G key 8" and the former location of the duplicate G# key 5" shown in FIG. 9. The vent key 114 covers vent opening 111 and is shown in line with the G key 8" and A hole 10" but it may be located at any point on the circumference of the tube within the above longitudinal parameter.

The vent key 114 is biased to an open position with the G key and is closed simultaneously by pressing on the G key 8". The flute with the present modification is played with the same fingering as the prior art flute illustrated in FIG. 9. The G# arm 103 is moved toward the foot of the flute but remains connected to axle 104. The touch portion 115 of the G# lever is extended toward the head of the flute to retain the same fingering.

Another form of the invention is illustrated in FIGS. 10—13. This form of the invention utilizes a double vent key 214 instead of the single vent key illustrated in FIG. 2.

Figure 10:
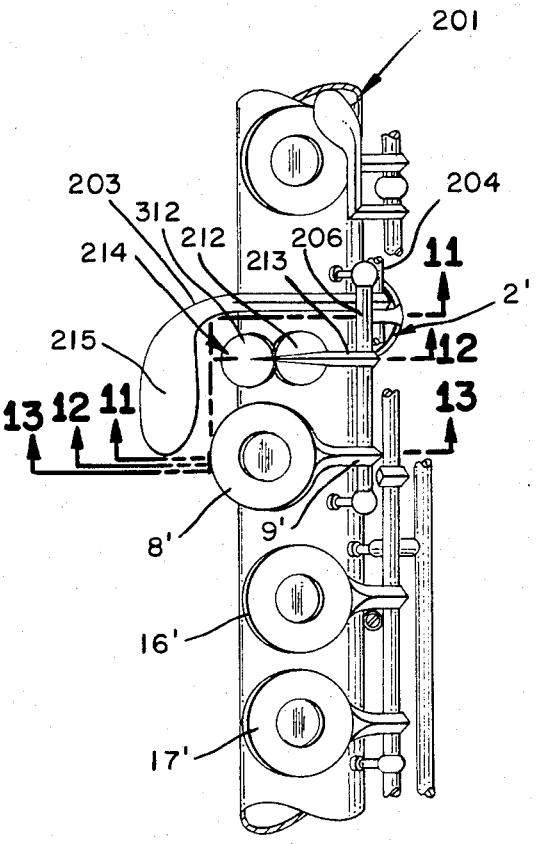
FIG. 10 is an enlarged view of a portion of an offset Boehm system flute similar to the section of the flute shown in FIG. 6 and showing a modified form of the invention.
Figure 11:
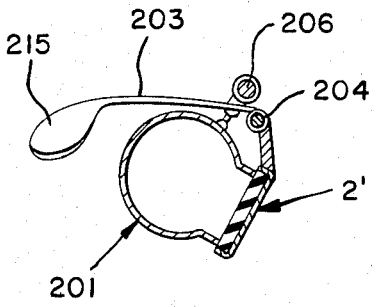
FIG. 11 is a cross sectional view of the flute shown in FIG. 10 taken along line 11—11.
Figure 12:
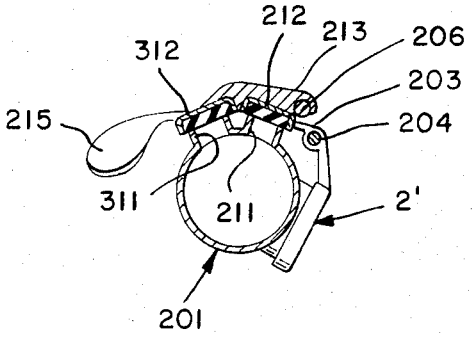
FIG. 12 is a cross sectional view of the flute shown in FIG. 10 taken along line 12—12.

The portion of the offset key, closed G# key flute 201 illustrated in FIG. 10 is identical to Prior Art flute 1' illustrated in FIG. 14 except for the modification set forth below.

The G key 8' covering the A hole 10' remains in the same position as in the prior art flute illustrated in FIG. 14. The duplicate G# key 5' and extra hole, however, are deleted. Dual vent holes 211 and 311 are formed in the flute tube at a location between the deleted extra hole and the A hole. As stated above, the optimum placement of the dual vent holes is as close to the A hole as possible. The dual vent holes may be placed at any lateral position on the flute tube. The position shown is only illustrative of one possible position. The dual vent key 214 includes covers 212 and 312 connected by a vent arm 213 to axle 206. The dual vent key 214 and the G key 8' are both biased to the open position and open and close conjointly when the G key 8' is pressed.

Addition of the dual vent key 214 requires the relocation of the standard G# lever which is shown in FIG. 10 and indicated by the number 203. The G# lever 203 is moved along the longitudinal axis of flute tube 201 toward the foot of the flute. G# lever 203 pivots about axle 204 and opens the G# key 2' which is normally biased to a closed position by a spring. The touch portion 215 of the G# lever 203 is elongated in the direction of the head of the flute so that the same fingering is maintained as is used in the prior art off set flute illustrated in FIG. 14. The improved flute is played in an identical manner as the prior art flute shown in FIG. 14.

The vent hole 11 in the flute 1, vent hole 111 in flute 101 and the dual vent holes 211 and 311 in flute 201 are close to their respective G keys 8', and 8" for the purpose of venting the tone A. For convenience of construction, the dual vent holes 211 and 311 are equal in size but need not be identical. The hole size dimensions are not critical inasmuch as the holes constitute a venting area and not a tone hole. In other words, the vent holes need to be large enough to provide venting for the tone A but not so large that they adversely affect high E. The total area of opening is a matter of adjustment: for different flute scales and tone hole placement and dimensions, the vent holes can be varied to provide optimum results.

The flutes of the present invention are constructed with standard hole openings, axles and pads for the vent keys.

I claim:

1. An improvement in a modern Boehm system flute having a closed G# which is opened by a G# lever and includes a duplicate G# key and extra hole comprising:

a. deleting said duplicate G# key and extra hole;

b. a vent means having an open area substantially smaller than said extra hole opening;

c. vent cover means for selectively closing said open area;

d. said vent means is longitudinally located between said deleted extra hole and the A hole of said flute;

e. a G key selectively covering said A hole;

f. connection means permitting the controlled conjoint opening and closing of said G key and said vent cover means; and g. relocating said G# lever toward the open end of said flute to provide space for said vent means and elongating the length of said lever to permit standard fingering.

2. An improved flute as described in claim 1 comprising:

a. said vent means includes a single vent hole and a single vent key.

3. An improved flute as described in claim 1 comprising:

a. said vent means includes a dual vent hole and a dual vent cover connected to a single arm.

4. An improved flute as described in claim 1 wherein;

a. said connection means includes a G rod mounted on said flute for pivotal movement;

b. said G key includes an arm connected to said G rod; and c. said vent cover means includes an arm connected to said G rod.

* * * * *